US008496000B2

(12) United States Patent
Keith

(10) Patent No.: US 8,496,000 B2
(45) Date of Patent: Jul. 30, 2013

(54) DRY SNORKEL

(76) Inventor: Glen Keith, San Marcos, CA (US)

( * ) Notice: Subject to any disclaimer, the term of this patent is extended or adjusted under 35 U.S.C. 154(b) by 1161 days.

(21) Appl. No.: 11/764,646

(22) Filed: Jun. 18, 2007

(65) Prior Publication Data

US 2008/0308099 A1 Dec. 18, 2008

(51) Int. Cl.
*B63C 11/16* (2006.01)

(52) U.S. Cl.
USPC ..... 128/201.11; 128/201.27

(58) Field of Classification Search
USPC ..... 128/201.11, 200.24, 200.29, 201.27, 128/201.26, 201.28, 202.14, 202.13, 206.29; 405/186, 187
See application file for complete search history.

(56) References Cited

U.S. PATENT DOCUMENTS

| | | | | |
|---|---|---|---|---|
| 2,815,751 | A | 12/1957 | Ferraro | |
| 2,909,959 | A | 10/1959 | Girden | |
| 3,141,469 | A | 7/1964 | Stradella | |
| 3,166,083 | A | 1/1965 | Girden | |
| 5,865,169 | A * | 2/1999 | Lan et al. | 128/201.11 |
| 5,960,791 | A | 10/1999 | Winefrodner et al. | |
| 6,994,085 | B2 | 2/2006 | Shiue | |
| 7,069,927 | B1 | 7/2006 | Pan | |
| 7,165,545 | B1 * | 1/2007 | Shiue | 128/201.11 |
| 2003/0047182 | A1 * | 3/2003 | Chen-Lieh | 128/201.11 |
| 2004/0226557 | A1 | 11/2004 | Shiue | |
| 2006/0254582 | A1 * | 11/2006 | Christianson | 128/201.11 |
| 2008/0047552 | A1 * | 2/2008 | McCarthy | 128/201.11 |

FOREIGN PATENT DOCUMENTS

| | | |
|---|---|---|
| GB | 457663 | 12/1936 |

* cited by examiner

*Primary Examiner* — Justine Yu
*Assistant Examiner* — Colin W Stuart
(74) *Attorney, Agent, or Firm* — Venable, Campillo, Logan & Meaney, P.C.

(57) ABSTRACT

A snorkel adapter apparatus is disclosed. The snorkel adapter apparatus includes a snorkel tube, a float, a mouthpiece, and a single pivot point. These pieces combined together create a snorkel breathing apparatus that allows the user to submerge the snorkel in water and prevent water from entering the snorkel tube and mouthpiece. When the snorkel is submerged in water, the float rotates around a coupler attached to the pivot attachment point and closes the open end of the snorkel tube. The buoyancy of the float in the water causes it to rotate and seal the snorkel tube closed.

32 Claims, 4 Drawing Sheets

DRY SNORKEL

FIELD OF THE INVENTION

The present invention relates generally to a breathing apparatus and, more particularly, to a dry snorkel that includes a pivot attachment point and a float that seals the open end of the snorkel tube when the snorkel is submerged under water.

BACKGROUND OF THE INVENTION

The use of dry snorkels is well known in the prior art. Specifically, dry snorkels are used by divers to keep water from entering their snorkel tubes and mouthpieces. Water that enters the snorkel tube may cause divers to take on water which may lead to choking or obstructed breathing while submerged. Additionally, when divers wish to submerge under water to explore their surroundings, they want assurance that water will not enter their snorkel tubes. If water does enter the snorkel tube and the diver is emerging from the water, he or she must blow out the water. This can be difficult if the diver has been submerged for a very long period of time. Therefore, it is desirable that a snorkel tube be designed to prohibit water from entering the air inlet end of a snorkel tube.

Additionally, a diver wants to prohibit water from entering the snorkel tube when waves are abundant. Therefore, it is desirous to utilize a snorkel design that allows the air inlet of the snorkel to remain open during normal operation, but is sealed when the snorkel tube is engulfed by water.

Various techniques have been disclosed in U.S. Pat. No. 2,815,751 (Ferraro), U.S. Pat. No. 2,909,959 (Girden), U.S. Pat. No. 3,141,469 (Stradella), U.S. Pat. No. 3,166,083 (Girden), U.S. Pat. No. 5,960,791 (Winefrodner et al), U.S. Pat. No. 6,994,085 (Shiue), U.S. Pat. No. 7,069,927 (Pan), U.S. Patent Application No. 20040226557 (Shiue), and Great Britain Pat. No. 457663 (Nicholson) to overcome the problems with water entering the open end of a snorkel tube. However, these disclosures suffer from one or more of the following disadvantages. First, none of these inventions include a float that pivots on a single point. Second, all of these designs are cumbersome and add to the weight and bulk of the snorkel gear. Third, none of these inventions are simple designs that are easy and relatively inexpensive to manufacture.

SUMMARY OF THE INVENTION

The present invention is directed to a snorkel adapter apparatus that provides a diver the ability to prohibit water from entering a snorkel tube when submerged in water or engulfed by waves.

A snorkel adapter apparatus of the present invention comprises a float, a gasket seal, and a pivot attachment point for connecting to the air inlet of a snorkel tube. The snorkel tube has a first end that further comprises a mouth piece, and a second end that is in an open position such that air passes through the snorkel tube when the snorkel tube is above water. The float is coupled to the second end of the snorkel tube at the pivot attachment point such that when the snorkel tube is submerged in water, the float pivots on the pivot attachment point and seals the second end of the snorkel tube with the gasket seal.

It is an object of the present invention to provide a snorkel adapter apparatus that prohibits water from entering the snorkel tube when submerged under water.

It is a further object of the present invention to provide a snorkel apparatus that includes a float attached to the snorkel tube by a pivot attachment point.

It is a further object of the present invention to provide a snorkel adapter apparatus that prevents water from entering the snorkel tube when engulfed by water.

The novel features that are considered characteristic of the invention are set forth with particularity in the appended claims. The invention itself, however, both as to its structure and its operation together with the additional object and advantages thereof will best be understood from the following description of the preferred embodiment of the dry snorkel when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6 are sought to be invoked to define the invention (s), the claims will specifically state the phrases "means for" or "step for" and a function, without also reciting in such phrases any structure, material, or act in support of the function.

Moreover, even if the provisions of 35 U.S.C. §112, paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later developed equivalent structures, materials, or acts for performing the claimed function.

DESCRIPTION OF PREFERRED EMBODIMENTS

Figure 10:
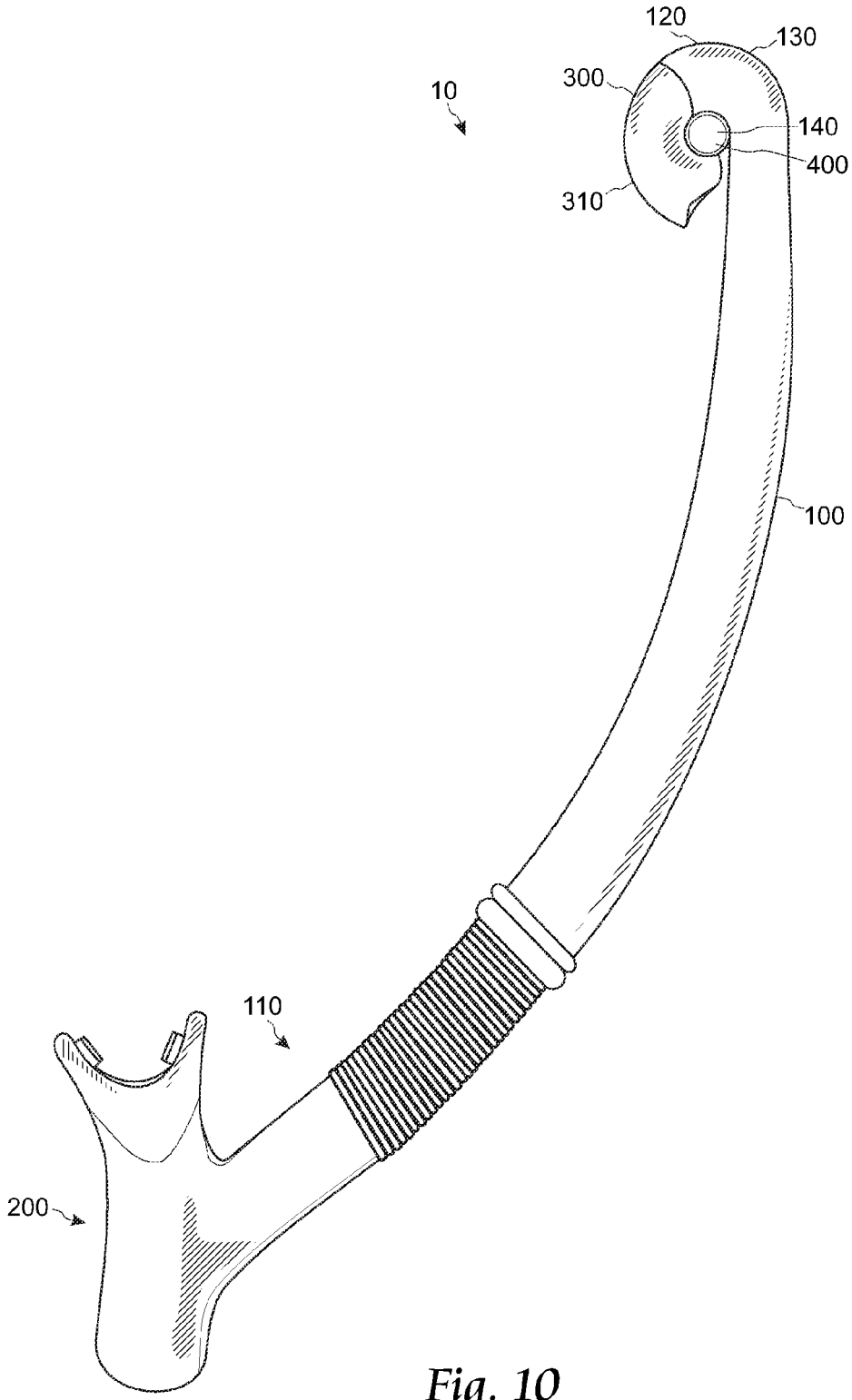
FIG. 10 shows a perspective view of the preferred embodiment of the invention with the float in a closed position and the mouthpiece.

A perspective view of a snorkel adapter apparatus 10 is shown in FIG. 10. The preferred embodiment of the invention includes a snorkel tube 100, a mouthpiece 200, a float 300, and a pivot attachment point 400. These components work together to create a snorkel adapter apparatus 10 that closes when submerged in water to keep water from entering the snorkel tube 100. The snorkel tube 100 comprises a first end 110 where the mouthpiece 200 is coupled to the snorkel tube 100, and a second end 120 where the float 300 is coupled to the snorkel tube 100. When above water, the second end 120 of the snorkel tube 100 remains open to enable a diver to breathe through the mouthpiece 200. In the preferred embodiment, the snorkel tube 100 is curved 130 at the second end 120.

Figure 5:
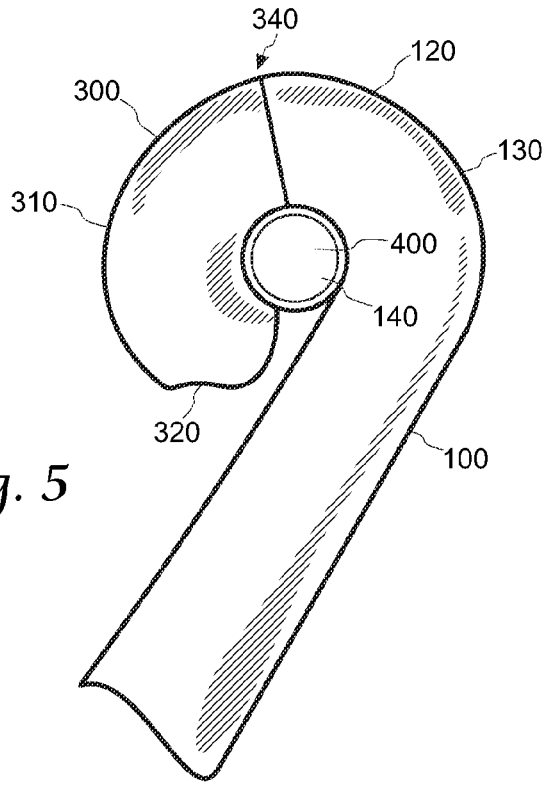
FIG. 5 shows a perspective view of the invention with the float attached to the snorkel tube and in a closed position.
Figure 6:
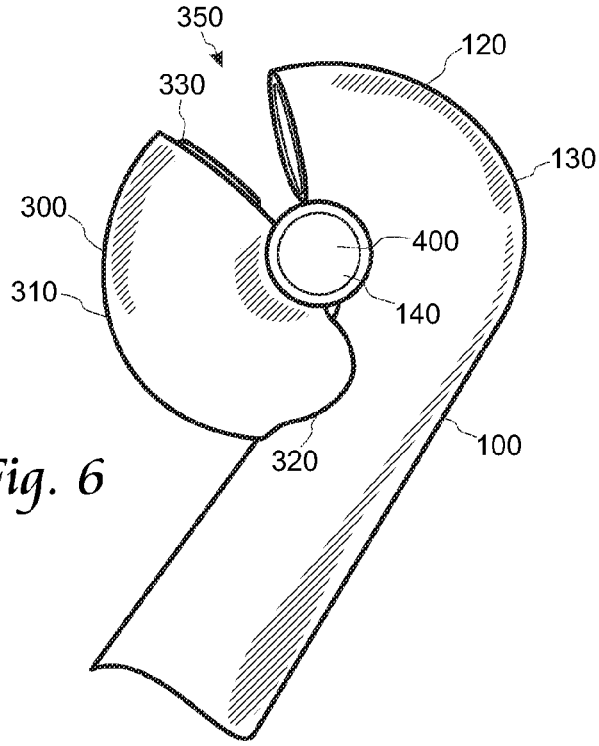
FIG. 6 shows a perspective view of the invention with the float attached to the snorkel tube and in an open position.

As shown in FIGS. 5 and 6, the float 300 is coupled to the snorkel tube 100 via a pivot attachment point 400. In the preferred embodiment, the pivot attachment point 400 is located at the curve 130 of the second end 120 of the snorkel tube 100. More specifically, the curve 130 at the second end 120 of the snorkel tube 100 forms an axis 150. The float 300 is then rotatably coupled about the axis 150 of the curve 130 with a coupler 140. Preferably, the coupler 140 is a pin, screw, or any other coupler that allows the float 300 to rotate about the axis 150. In the preferred embodiment, the float 300 has a substantially similar curve shape 310 as the curve 130 of the second end 120 of the snorkel tube 100. These curves 130 and 310 define the axis 150 upon which the float 300 rotates.

Figure 1:
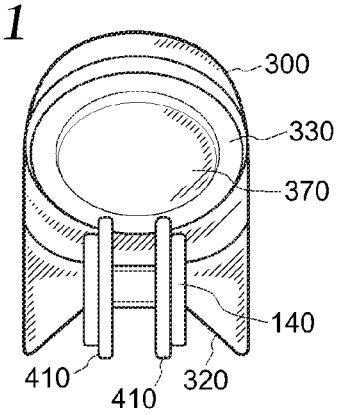
FIG. 1 shows the gasket end view of the preferred embodiment of a float.
Figure 2:
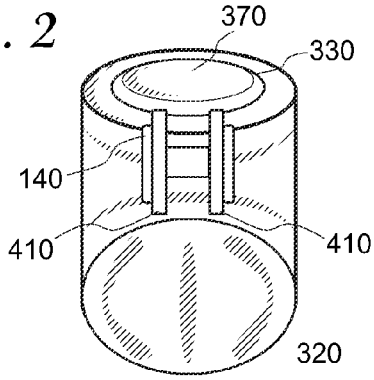
FIG. 2 shows the free end view of the preferred embodiment of the float.
Figure 3:
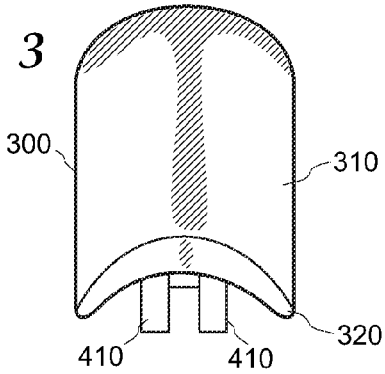
FIG. 3 shows the curve of the back of the preferred embodiment of the float.

In the preferred embodiment of the invention the snorkel tube 100 has two prongs 170 that project from the curve 130 of the snorkel tube 100. These two prongs 170 include holes 175 that form the axis 150 upon which the float 300 is rotatably coupled to the snorkel tube 100. Additionally, the float 300 comprises two legs 410 with holes 420 as seen in FIGS. 1-3. The holes 420 on the legs 410 of the float 300 fit on the outside of the prongs 170 on the snorkel tube 100, and the holes 175 and 420 in each line up and form the pivot attachment point 400 upon which the float 300 rotates. The coupler 140 fits through the four holes 175 and 420 on each piece and allows the float 300 to rotate about the axis 150. As stated above, the coupler 140 that attaches these pieces can be a pin, screw, or any other coupler that allows the float 300 to rotate. In the preferred embodiment, the coupler 140 is a pin that is made of plastic.

The float 300 may be in a closed position 340 as shown in FIG. 5 or an open position 350 as shown in FIG. 6. When above water, the float 300 opens so that air can enter the snorkel tube 100 and flow to the diver through the mouthpiece 200. When submerged under water or engulfed by a wave, the float 300 rotates to the closed position 340 by rotating the coupler 140 along the pivot attachment point 400 so that water is prevented from entering the snorkel tube 100 and the mouthpiece 200.

In the preferred embodiment, the float 300 is made of a material that is buoyant in water, such as plastic, foam, or related material. In an alternate embodiment, the float 300 can be made of a non-buoyant material that creates an air chamber that acts as a float 300. When the float 300 is submerged in water or is engulfed by a wave, it rotates upward to the closed position 340 on the coupler 140 attached to the pivot attachment point 400 because of its buoyancy. As seen in FIGS. 1-3, the float 300 further comprises a free end 320 and a gasket end 330. When the float 300 rotates to the closed position 340, the gasket end 330 comes into contact with the second end 120 of the snorkel tube 100 that is open to the air. The gasket end 330 of the float 300 further comprises a gasket seal 360 that fits into the second end 120 of the snorkel tube 100 and seals the second end 120 of the snorkel tube 100 closed. The gasket seal 360 is made of a material such as rubber or plastic that will prevent water from entering the snorkel tube 100.

Figure 4:
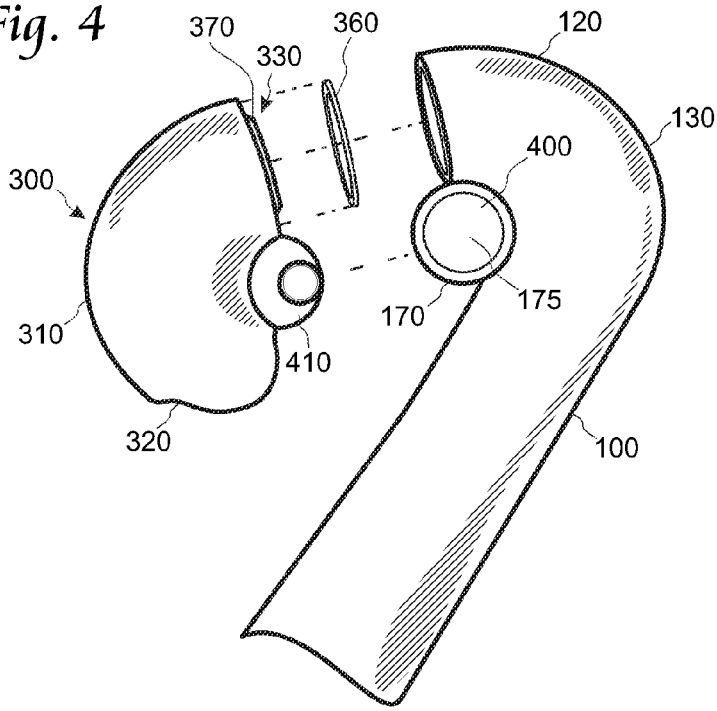
FIG. 4 shows an exploded view of the float and snorkel tube with the gasket seal in the middle.

In the preferred embodiment, the gasket seal 360 shown in FIG. 4 is in the shape of a ring. It securely fits onto the gasket end 330 of the float 300 to prevent water from entering the snorkel tube 100. Preferably, the gasket seal 360 fits over a rounded protrusion 370 on the gasket end 330 of the float 300. The protrusion 370 fits into the second end 120 of the snorkel tube 100 such that water is prohibited from entering the snorkel tube 100, and allows the protrusion 370 to easily release from the second end 120 of the snorkel tube 100 when the snorkel tube 100 emerges from the water, and the float 300 rotates to the open position 350. The gasket seal 360 aids in properly sealing the protrusion 370 of the gasket end 330 to the second end 120 of the snorkel tube 100 so that water does not enter the snorkel tube 100. In an alternate embodiment not shown, the gasket seal 360 may be located on the second end 120 of the snorkel tube 100. It functions the same as when it is attached to the gasket end 330 of the float 300.

The float 300 shown in FIGS. 1-4 shows the free end 320 and the gasket end 330 of the float 300 in several different views. FIGS. 1-3 show views of the float 300 with the coupler 140 inserted through the holes 420 in the legs 410 of the float 300. Also shown in FIG. 4 is the gasket seal 360 detached from the float 300. As seen in FIGS. 2, 3 and 4, the free end 320 of the float 300 is contoured so that when the float 300 is in the open position 350, the free end 320 fits against the snorkel tube 100.

Figure 7:
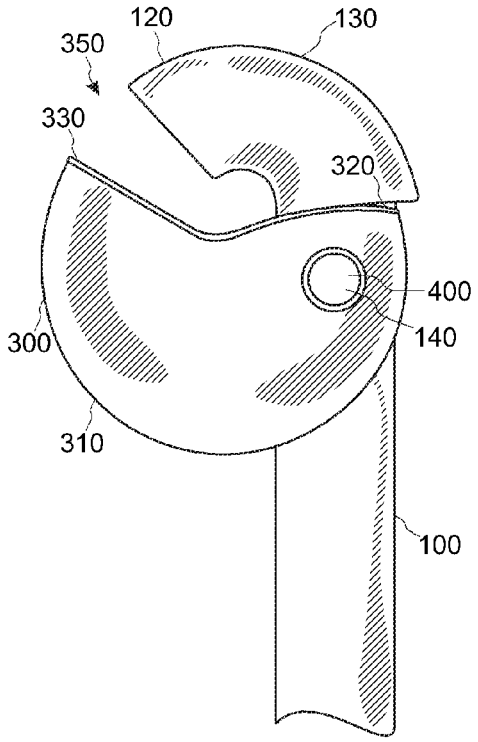
FIG. 7 shows an alternate embodiment of the invention with the float attached to the snorkel tube and in the open position.
Figure 8:
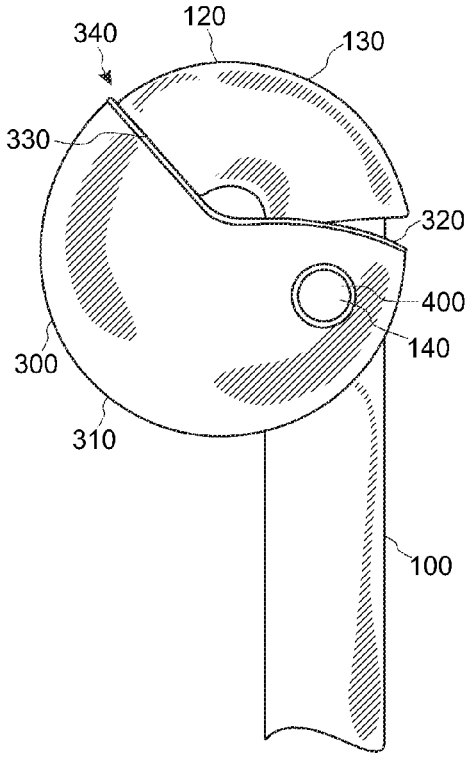
FIG. 8 shows an alternate embodiment of the invention with the float attached to the snorkel tube and in the closed position.
Figure 9:
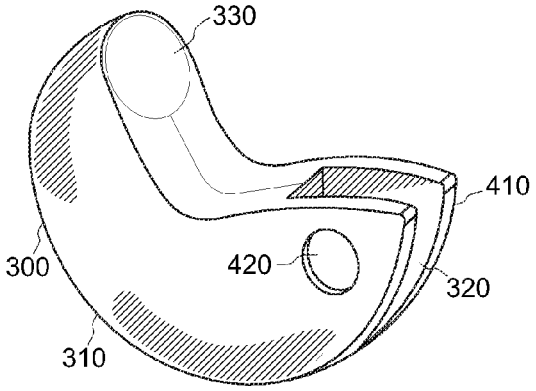
FIG. 9 shows an alternate embodiment of the float.

In an alternate embodiment, shown in FIGS. 7, 8, and 9, the float 300 is attached directly to the snorkel tube 100 via a coupler 140. Instead of two prongs 170 projecting from the curved part of the snorkel tube 100, the pivot attachment point 400 is directly on the snorkel tube 100. The float 300 still rotates about the coupler 140 on the pivot attachment point 400 to close the second end 120 of the snorkel tube 100. The shape of the float 300, however, is slightly different in this alternate embodiment.

Here, the float 300 is curved and is substantially the shape of a half circle. The holes 420 and legs 410 of the float 300 are an integral part of the float 300. The free end 320 of the float 300 includes the legs 410 and holes 420 through which the coupler 140 is inserted. The legs 410 are a distance apart from each other such that they fit around the snorkel tube 100. In this embodiment, the snorkel tube 100 includes a hole 180 drilled through at least one side so that the coupler 140 can couple the float 300 to the snorkel tube 100.

Further, in this embodiment, the free end 320 of the float 300, when in the open position 350, as shown in FIG. 7, rests against the second end 120 of the snorkel tube 100. When in the closed position 340, as shown in FIG. 8, the gasket end 330 seals the second end 120 of the snorkel tube 100 to prevent water from entering. The gasket seal 360 fits onto the float 300 the same way as in the preferred embodiment. The rounded protrusion 370 on the gasket end 330 of the float 300 fits into the second end 120 of the snorkel tube 100. The gasket seal 360 fits around the protrusion 370 and seals water out of the snorkel tube 100 and mouthpiece 200.

The preferred embodiment of the invention is described in the Description of Preferred Embodiments. While these descriptions directly describe the one embodiment, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A snorkel adapter apparatus for use with a snorkel tube comprising:

a float wherein said float is coupled to an air inlet end of a snorkel tube at a pivot attachment point; and when said float is submerged, said float rotates around said pivot attachment point to a position wherein said float directly contacts the air inlet end of said snorkel tube;

wherein said float further comprises a free end such that when said float is in an open position said free end of said float essentially surrounds an outer surface of said snorkel tube.

2. The snorkel adapter apparatus of claim 1 wherein a gasket is coupled to said float such that said gasket provides a seal between said float and the air inlet end of said snorkel tube when said float is submerged.

3. The snorkel adapter apparatus of claim 1 wherein a gasket is coupled to said air inlet end of said snorkel tube such that said gasket provides a seal between said float and the air inlet end of said snorkel tube when said float is submerged.

4. The snorkel adapter apparatus of claim 1 wherein said pivot attachment point is located at a curved end of said snorkel tube such that said curved end of said snorkel tube forms an axis that defines the location of said pivot attachment point.

5. The snorkel adapter apparatus of claim 4 wherein said float is curved substantially similar to said curved end of said snorkel tube.

6. The snorkel adapter apparatus of claim 5 wherein said float further comprises a pair of legs, said pair of legs further comprising a hole through each leg such that said float is coupled to said pivot attachment point through said holes.

7. The snorkel adapter apparatus of claim 1 wherein said float is rotatably coupled to the air inlet end of said snorkel tube at said pivot attachment point with a pin.

8. The snorkel adapter apparatus of claim 1 wherein said float is made of a buoyant material.

9. A snorkel apparatus comprising:

a snorkel tube with a first end and a second end wherein said second end includes an airway;

a float;

wherein said float is coupled to said second end of said snorkel tube at a pivot attachment point; and when said snorkel tube is submerged, said float pivots around said pivot attachment point such that said float is moved to a position wherein said float directly contacts the airway of said snorkel tube at its second end;

wherein said float further comprises a free end such that when said float is in an open position said free end of said float essentially surrounds an outer surface of said snorkel tube.

10. The snorkel apparatus of claim 9 wherein a gasket is coupled to said float such that said gasket provides a seal between said float and said airway when said float is submerged.

11. The snorkel apparatus of claim 9 wherein said second end of said snorkel tube is curved.

12. The snorkel apparatus of claim 11 wherein said pivot attachment point is located at said curved second end of said snorkel tube such that said curve forms an axis that defines the location of said pivot attachment point.

13. The snorkel apparatus of claim 12 wherein said float is curved substantially similar to said curved second end of said snorkel tube.

14. The snorkel apparatus of claim 13 wherein said float further comprises a pair of legs, said pair of legs further comprising a hole through each leg such that said float is coupled to said pivot attachment point through said holes.

15. The snorkel apparatus of claim 9 wherein said float is rotatably coupled to said snorkel tube at said pivot attachment point with a pin.

16. The snorkel apparatus of claim 9 wherein said float is made of a buoyant material.

17. A method of using a snorkel adapter apparatus with a snorkel tube comprising the steps of:

coupling a float to a snorkel tube at a pivot attachment point; and submerging said float, wherein said float pivots around said pivot attachment point such that said float is moved to a position wherein said float directly contacts an airway of said snorkel tube;

further comprising the step of providing a free end of said float such that when said float is in an open position said free end of said float essentially surrounds an outer surface of said snorkel tube.

18. The method of claim 17 further comprising the step of coupling a gasket to said float such that said gasket provides a seal between said float and the airway of said snorkel tube.

19. The method of claim 17 further comprising the step of coupling a gasket to said airway of said snorkel tube such that said gasket provides a seal between said float and the airway of said snorkel tube.

20. The method of claim 17 further comprising the step of locating said pivot attachment point at a curved end of said snorkel tube such that said curved end of said snorkel tube forms an axis that defines the location of said pivot attachment point.

21. The method of claim 20 further comprising the step of curving said float substantially similar to said curved end of said snorkel tube.

22. The method of claim 21 further comprising the step of providing said float wherein said float further comprises a pair of legs, said pair of legs further comprising a hole through each leg and coupling said float to said pivot attachment point through said holes.

23. The method of claim 17 further comprising the step of rotatably coupling said float to said snorkel tube at said pivot attachment point with a pin.

24. The method of claim 17 further comprising the step of making said float of a buoyant material.

25. A snorkel adapter apparatus for use with a snorkel tube comprising:

a float wherein said float is coupled to an air inlet end of a snorkel tube at a pivot attachment point and said float further comprises a protrusion; and when said float is submerged, said float rotates around said pivot attachment point to a position wherein said protrusion of said float directly contacts an airway of the air inlet end of said snorkel tube;

wherein said float further comprises a free end such that when said float is in an open position said free end of said float essentially surrounds an outer surface of said snorkel tube.

26. The snorkel adapter apparatus of claim 25 wherein a gasket is coupled to said float such that said gasket provides a seal between said float and the air inlet end of said snorkel tube when said float is submerged.

27. The snorkel adapter apparatus of claim 25 wherein a gasket is coupled to said air inlet end of said snorkel tube such that said gasket provides a seal between said float and the air inlet end of said snorkel tube when said float is submerged.

28. The snorkel adapter apparatus of claim 25 wherein said pivot attachment point is located at a curved end of said snorkel tube such that said curved end of said snorkel tube forms an axis that defines the location of said pivot attachment point.

29. The snorkel adapter apparatus of claim 28 wherein said float is curved substantially similar to said curved end of said snorkel tube.

30. The snorkel adapter apparatus of claim 29 wherein said float further comprises a pair of legs, said pair of legs further comprising a hole through each leg such that said float is coupled to said pivot attachment point through said holes.

31. The snorkel adapter apparatus of claim 25 wherein said float is rotatably coupled to the air inlet end of said snorkel tube at said pivot attachment point with a pin.

32. The snorkel adapter apparatus of claim 25 wherein said float is made of a buoyant material.

* * * * *